US009816525B1

(12) United States Patent
Sadler et al.

(10) Patent No.: US 9,816,525 B1
(45) Date of Patent: Nov. 14, 2017

(54) MOVABLE FAN ASSEMBLY MOUNTING ARRANGEMENT

(71) Applicant: Amazon Technologies, Inc., Seattle, WA (US)

(72) Inventors: Timothy Logan Sadler, Edmonds, WA (US); Matthew Thomas Phillips, Bainbridge Island, WA (US)

(73) Assignee: Amazon Technologies, Inc., Seattle, WA (US)

( * ) Notice: Subject to any disclaimer, the term of this patent is extended or adjusted under 35 U.S.C. 154(b) by 712 days.

(21) Appl. No.: 14/495,009

(22) Filed: Sep. 24, 2014

(51) Int. Cl.

| | |
|---|---|
| ***F04D 29/62*** | (2006.01) |
| ***F04D 29/60*** | (2006.01) |
| ***F04D 29/52*** | (2006.01) |
| ***F04D 29/64*** | (2006.01) |
| ***F04D 29/28*** | (2006.01) |
| ***F04D 25/14*** | (2006.01) |
| ***F04D 29/052*** | (2006.01) |
| ***F04D 25/12*** | (2006.01) |
| *F04D 29/70* | (2006.01) |
| *F04D 3/00* | (2006.01) |

(Continued)

(52) U.S. Cl.
CPC ..... *F04D 29/522* (2013.01); *F04D 25/12* (2013.01); *F04D 25/14* (2013.01); *F04D 29/052* (2013.01); *F04D 29/281* (2013.01); *F04D 29/626* (2013.01); *F04D 29/646* (2013.01); *F04D 3/005* (2013.01); *F04D 13/06* (2013.01); *F04D 19/002* (2013.01); *F04D 29/703* (2013.01)

(58) Field of Classification Search
CPC ..... F04D 3/005; F04D 13/06; F04D 19/002; F04D 25/12; F04D 25/14; F04D 29/052; F04D 29/281; F04D 29/522; F04D 29/626; F04D 29/646; F04D 29/703
See application file for complete search history.

(56) References Cited

U.S. PATENT DOCUMENTS

| | | | |
|---|---|---|---|
| 2,594,688 | A | 4/1952 | Shapiro |
| 2,710,717 | A | 6/1955 | Palmer |

(Continued)

FOREIGN PATENT DOCUMENTS

| | | |
|---|---|---|
| EP | 0838639 | 4/1998 |

OTHER PUBLICATIONS

Greenheck, "Sidewall Propeller Fans," Document 471755, http://www.greenheck.com/media/pdf/manuals/471755SidewallPropeller_iom.pdf (2008).

(Continued)

*Primary Examiner* — Igor Kershteyn
(74) *Attorney, Agent, or Firm* — Klarquist Sparkman, LLP

(57) ABSTRACT

A fan assembly comprises a fan and a movable fan support. The fan has a motor and a fan blade drivable by the motor to move air in an airflow direction through an opening. The movable fan support is configured to movably support at least the fan. The fan support is mountable adjacent the opening on a first side and comprises extension members extendable from an operating position on the first side of the opening to an access position on a second side of the opening opposite the first side. In the access position, the extension members extend through the opening from the first side to the second side to support the motor and fan blade on the second of the opening for access.

20 Claims, 3 Drawing Sheets

(51) Int. Cl.
*F04D 13/06* (2006.01)
*F04D 19/00* (2006.01)

(56) References Cited

U.S. PATENT DOCUMENTS

| | | | | |
|---|---|---|---|---|
| 2,711,285 | A * | 6/1955 | Burrowes | F04D 29/626 417/326 |
| 2,798,660 | A * | 7/1957 | Flynn | F04D 29/626 417/360 |
| 3,425,621 | A | 2/1969 | Greenheck | |
| 4,092,088 | A | 5/1978 | Nemesi | |
| 4,130,376 | A | 12/1978 | Dietsche | |
| 4,766,806 | A | 8/1988 | Tomiser, Jr. et al. | |
| 4,768,424 | A | 9/1988 | Frenkler et al. | |
| 5,185,941 | A | 2/1993 | Dongelmans | |
| 5,348,447 | A | 9/1994 | Redetzke | |
| 5,906,475 | A * | 5/1999 | Melane | F04D 29/601 403/326 |
| 6,027,406 | A * | 2/2000 | Yazici | F04D 29/601 181/224 |
| 6,190,122 | B1 | 2/2001 | McCabe | |
| 6,454,528 | B2 | 9/2002 | McCabe | |
| 6,616,404 | B1 | 9/2003 | Davis et al. | |
| 7,070,385 | B2 * | 7/2006 | Milana | F04D 25/14 415/125 |
| 7,077,627 | B2 | 7/2006 | Kupferberg | |
| 8,295,041 | B2 | 10/2012 | Cheng et al. | |
| 8,408,865 | B2 | 4/2013 | Sinzaki | |
| 8,485,777 | B2 * | 7/2013 | Takemae | F04D 17/08 415/127 |
| 8,535,128 | B2 | 9/2013 | Chwala | |
| 8,672,734 | B2 | 3/2014 | Labrecque | |
| 9,482,241 | B2 * | 11/2016 | Locker, Jr. | F04D 29/601 |

OTHER PUBLICATIONS

Pfleiderer, Donald, "Side wall fan hinge set up," http://talesofthegreaser.blogspot.com/2011/04/side-wall-fan-hinge-setup.html (Apr. 26, 2011).

ProTerra Systems, "Fans and Shutters," http://www.agilemfg.com/uploads/pdf/RX_3134_201305_ProTerraFanOverviewEM(1).pdf (2013).

Twin City Fans & Blowers, "Easy Access Industrial Exhaust Fans," Catalog GA200-A, http://www.tcf.com/docs/product-bulletins/easy-access-industrial-exhaust-fans---catalog-ga200.pdf?Status=Master (Sep. 2000).

* cited by examiner

MOVABLE FAN ASSEMBLY MOUNTING ARRANGEMENT

BACKGROUND

Large air movers, e.g., fans, used in heating, ventilating and air conditioning (HVAC) applications, require routine maintenance. In some settings, such as in commercial buildings, such fans are mounted directly over openings in the building side walls or roof through which the fans exhaust or intake air.

Conventionally, access to such fans is designed to take place on the side of the building on which the part(s) of the fan (usually the motor and/or fan blade) are located. Thus, if the fan motor is positioned mostly on the inside of the building, then the motor is designed to be serviced from the inside of the building. Conversely, for a fan that is mounted to the outside of the building, then the fan is designed to be serviced from outside the building. Servicing the fan can require moving it axially from away from the opening and/or pivoting it away from the opening. In any case, substantial additional space is required for this service or access position of the fan, in addition to the space it occupies in its normal operating position.

In some applications, it is not convenient or possible to provide such additional space. In other applications, providing access to the fan in its access position poses risks to maintenance personnel (e.g., if personnel must work at great heights within the inside of the building). It would be helpful to provide alternative solutions to accessing fans for maintenance and other purposes.

DETAILED DESCRIPTION

Described below is a fan mounting arrangement or fan assembly in which a fan having a motor and a fan blade is mounted on a movable fan support. The fan support is mounted adjacent an opening through which the fan moves air on a first side of the opening and has extension members extendable from a fan operating position on the first side of the opening to a fan access position on a second side of the opening. In the access position, the extension members extend through the opening from the first side to the second side so the motor and fan blade can be accessed from the second side. In some applications, the opening is fitted with one or more doors having louvers, and the door(s) can be opened to allow the fan to be moved to the access position.

Figure 1:
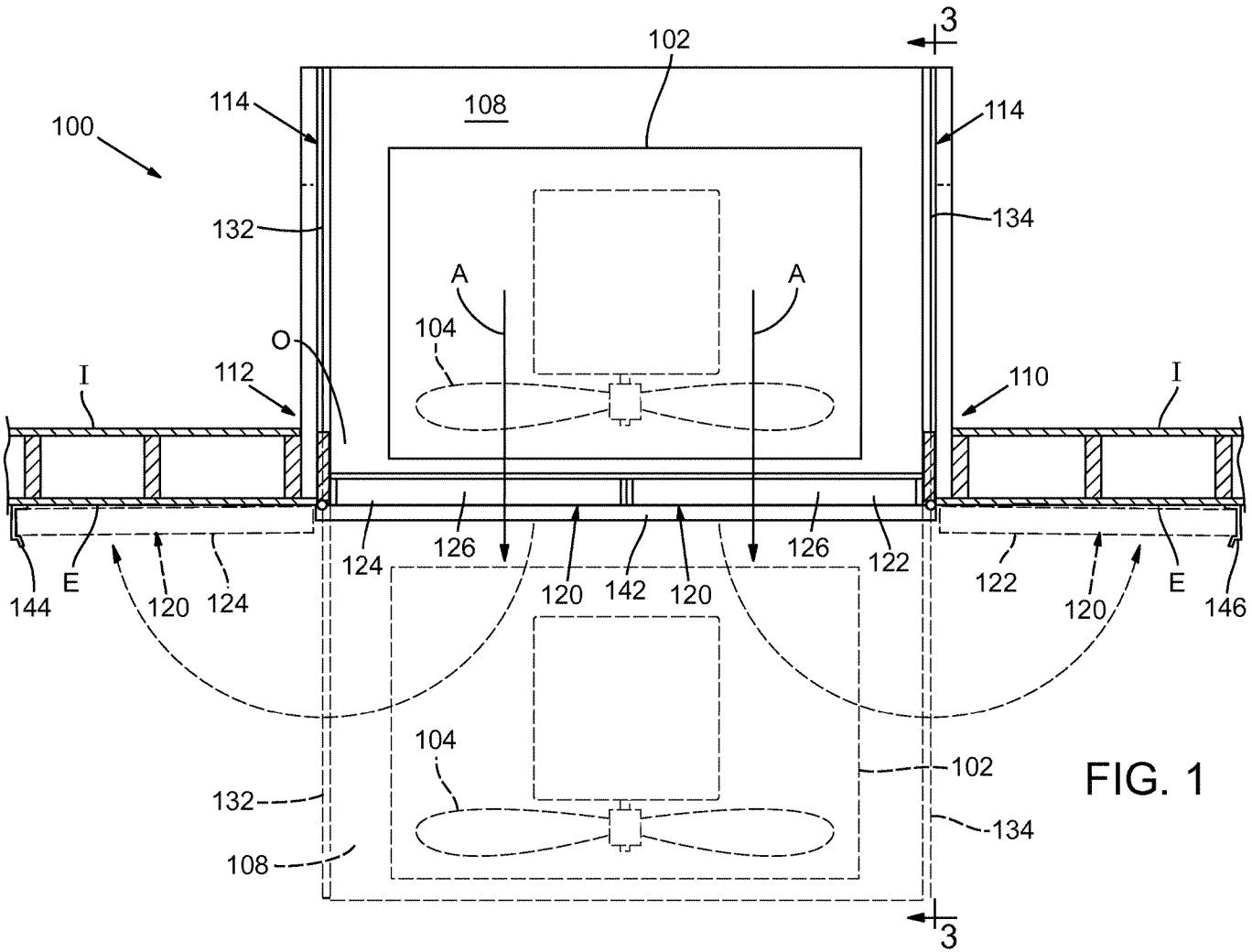
FIG. 1 is a sectioned plan view showing a fan mounting arrangement for a fan on a sliding support that can be moved from an operating position, through an opening in a wall or roof of a building and into an access position to allow maintenance personnel and others to access the fan, e.g., for service.
Figure 2:
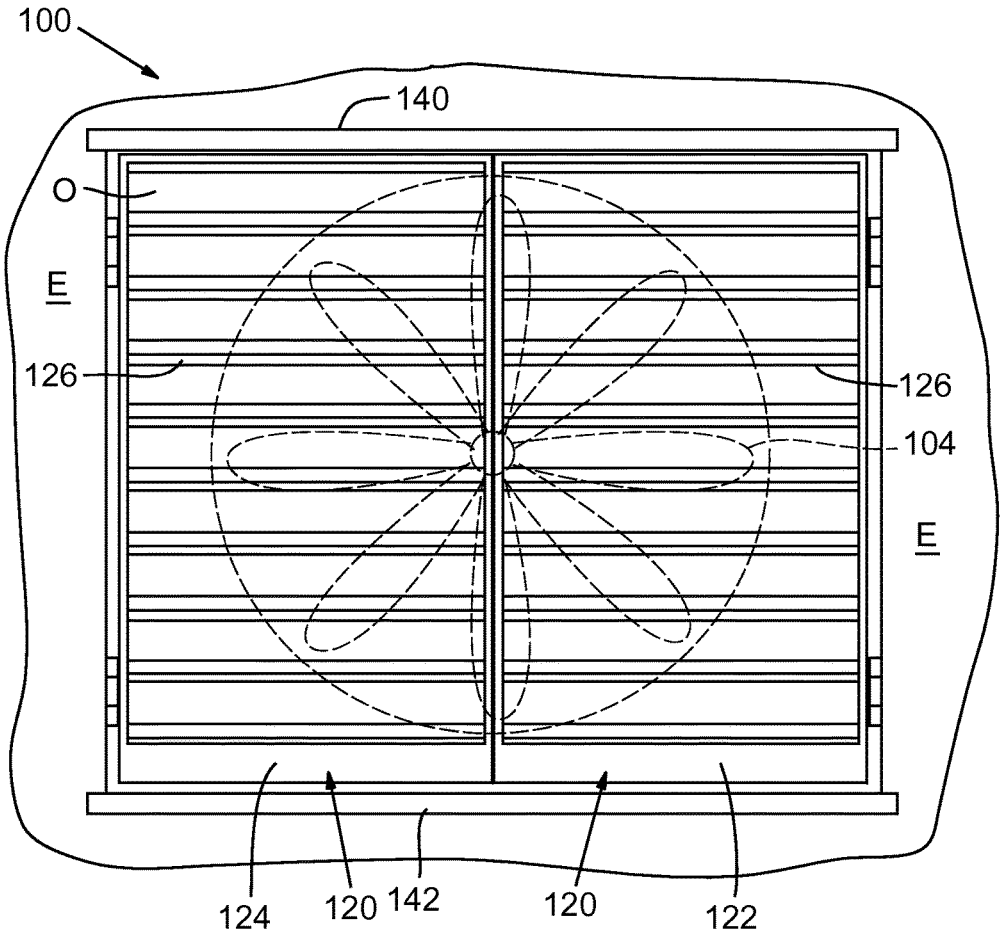
FIG. 2 is an elevation view of a portion of the fan mounting arrangement of FIG. 1, showing a pair of louvered doors in the closed position and covering the opening.
Figure 3:
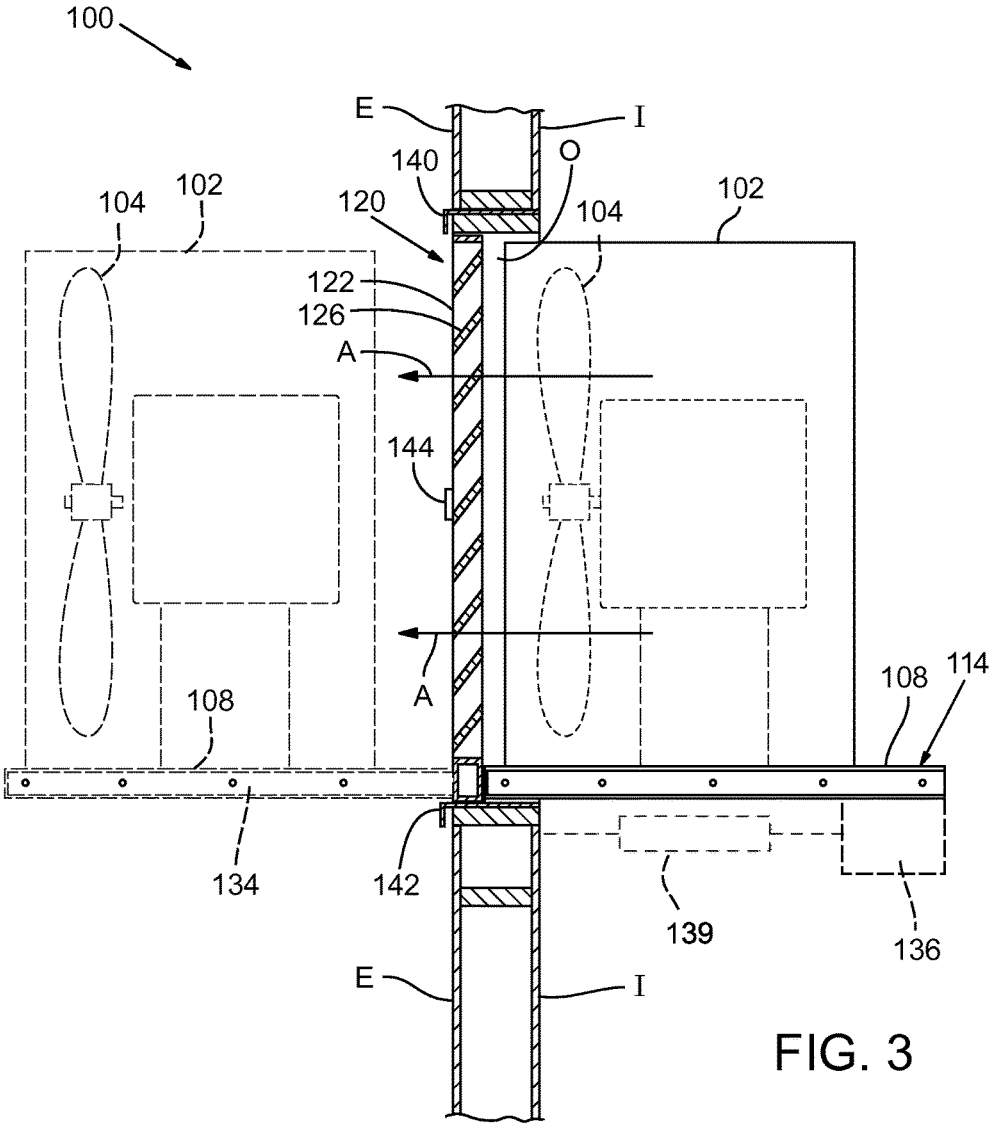
FIG. 3 is a sectioned side elevation view of the fan mounting arrangement of FIG. 1 showing the fan and sliding support in relation to the opening in both the operating position and the access position.

Referring to FIGS. 1-3, an implementation of a fan mounting arrangement or fan assembly 100 is shown. As shown somewhat schematically in FIG. 1, a fan 102 (or other type of air mover) has a motor and a fan blade 104, and is supported on a fan support 108. The fan 102 is typically arranged as shown, in-line with an opening O, such as an opening in a wall or roof of a building, through which the fan exhausts air or intakes air. In other implementations, the opening O may be arranged in an intermediate surface, such as in the wall of a housing, as one example. In one specific implementation, the fan 102 is mounted to a vertical wall of an inverted exhaust plenum having an exterior access position accessible from a walkable surface on a roof of a building, such as is disclosed in commonly owned U.S. patent application Ser. No. 14/308,114 entitled Inverted Exhaust Plenum Module, which was filed on Jun. 18, 2014.

The fan 102 is shown positioned on a first side 110 in its normal operating position. The fan 102 can be moved through the opening O to its access position (shown in dashed lines) on a second side 112, e.g., to access the fan motor, fan blade and/or other component. In the illustrated implementation, the fan 102 is configured as an exhaust fan that defines an airflow direction A as shown extending from the first side 110 to the second side 112. As examples only, the fan's belt or drive may require replacement or adjustment, the fan blade or the fan blade pitch may need to be changed and/or various electrical components may need to be replaced or serviced. As best seen in FIG. 3, the fan support 108 can enable the fan to translate between positions, e.g., by a combination of sliding and/or rolling motion. For example, the fan support 108 can have extension members 114 that can extend from the first side 110, through the opening O and to the second side 112. For example, the support 108 and the extension members 114 can comprise a conventional drawer slide type mechanism 132, 134 positioned in a spaced apart relation relative to each other. Such conventional drawer slide mechanisms are available for industrial applications with weight carrying capacities of 500 pounds, 1000 pounds or even more. In one representative application that has a 20 hp fan motor, the estimated weight to be supported by the drawer slides may be in the range from 700-1000 pounds. As one example, heavy duty slides sold by Barnes Engineering Company of Colorado Springs, Colo. (www.slim-track.com) have the weight carrying capacity and dimensions suitable for typical applications.

In some implementations, there is at least one door 120 provided to cover the opening O, typically from the second side 112. The door 120 may be hinged or otherwise movable (such as, e.g., by sliding) or removable to expose the opening O so that the fan 102 can be moved through the opening O to the second side 112 and into the access position. In the illustrated implementation, there is a pair of hinged doors 122, 124 in a bi-fold configuration that are arranged to cover the opening as shown in FIG. 2, and to expose the opening as shown in FIG. 1. The doors 122, 124 are omitted from FIG. 3 for clarity. The doors 122, 124 may be held in the open position by respective door retainers 144, 146.

The door or doors 120, 122, 124 may have louvers 126 or other form of openings through which air can be conveyed while the doors are closed and the fan is in operation. The louvers, which are sometimes referred to as a grille, are sized and shaped to provide adequate airflow yet prevent entry of water, debris, animals and trespassers. In some implementations, the louvers 126 are movable, either manually or with a mechanism (not shown) to adjust the amount of airflow through the doors.

Referring to FIG. 3, the fan support 108 may be positioned to support the fan 102 in a cantilevered arrangement as shown with the support 108 coupled at one of its ends, such as to a wall as shown. Alternatively, the fan 102 may be supported by one or more additional members, such as the member 136 shown in FIG. 3, at least when the fan 102 is in the operating position. The member 136 can be provided to support the end of the support 108 that is spaced from the wall when the fan 102 is in the operating position.

As also shown in FIG. 3, there may be an optional assistance device 139, such as an actuator or a spring, as just two examples, to assist a user in moving the weight of the fan 102 and its associated structure. The assistance device 139 is particularly useful in applications where the fan 102 is moved vertically upward against the action of gravity, such as in applications where the opening O is in a horizontal roof surface. One exemplary source for an actuator suitable for the assistance device 139 is Parker Hannefin Corp.

As shown in FIGS. 2 and 3, the opening O can be fitted with head flashing 140 and/or sill flashing 142 as appropriate for the operating environment and conditions.

In one implementation, the fan support 108 has a width of about 9 feet. Thus, each of the doors 122, 124 has a width of about 4 feet 6 inches. The depth of the fan support, and the corresponding amount of extension provided to permit the fan 102 to be moved from the operating position to the access position, can be between about 3 feet and about 5 feet. Of course, these dimensions can be adapted for specific implementations as would be understood by those with ordinary skill in the art.

The disclosed methods, apparatus, and systems should not be construed as limiting in any way. Instead, the present disclosure is directed toward all novel and nonobvious features and aspects of the various disclosed embodiments, alone and in various combinations and subcombinations with one another. The disclosed methods, apparatus, and systems are not limited to any specific aspect or feature or combination thereof, nor do the disclosed embodiments require that any one or more specific advantages be present or problems be solved.

In view of the many possible embodiments to which the disclosed principles may be applied, it should be recognized that the illustrated embodiments are only preferred examples and should not be taken as limiting the scope of protection. Rather, the scope of protection is defined by the following claims. We therefore claim all that comes within the scope of these claims.

What is claimed is:

1. A side wall fan assembly, comprising:

a fan having a motor and fan blade drivable to move air in an airflow direction through an opening in a side wall of a building;

a movable fan support configured to movably support at least the fan, the fan support being mountable adjacent the opening on a first side and comprising extension members extendable from an operating position on the first side of the opening to an access position on a second side of the opening opposite the first side, wherein in the access position, the extension members extend through the opening from the first side to the second side to support the motor and fan blade on the second side of the opening for access; and at least one door positionable on the second side and movable between a closed position covering the opening and an open position exposing the opening.

2. The fan assembly of claim 1, wherein the at least one door comprises first and second doors in a bi-fold configuration.

3. The fan assembly of claim 1, wherein the at least one door comprises louvers through which air can flow.

4. The fan assembly of claim 3, wherein the louvers are movable between at least open and closed positions.

5. The fan assembly of claim 1, further comprising at least one seal positioned between the at least one door and a surrounding stationary part.

6. The fan assembly of claim 1, wherein the opening is in a side wall of a building, and wherein the first side of the opening is defined at an interior side of the side wall, and the second side of the opening is defined at an exterior side of the side wall.

7. The fan assembly of claim 1, wherein the opening is in a side wall of a building, and wherein the first side of the opening is defined at an exterior side of the side wall, and the second side of the opening is defined at an interior side of the side wall.

8. The fan assembly of claim 1, wherein the movable fan support has a sidewall configuration with a stationary portion coupleable to a side wall of a building.

9. The fan assembly of claim 1, wherein the fan is configured as an exhaust fan for a building.

10. The fan assembly of claim 1, wherein the fan is configured as an intake fan for a building.

11. The fan assembly of claim 1, wherein the movable fan support comprises at least two spaced apart drawer slides.

12. The fan assembly of claim 11, wherein the drawer slides are mounted to a side wall of a building so as to form a cantilevered support for the fan.

13. The fan assembly of claim 1, further comprising at least one door retainer for retaining the door in an open position when the fan is in the access position.

14. The fan assembly of claim 1, wherein the movable fan support supports the fan from below.

15. The fan assembly of claim 1, wherein in at least the operating position, the movable fan support has a fixed end attached to a wall and a free end that contacts and is supported by at least one horizontal member.

16. A fan assembly, comprising:

a fan having a motor and fan blade drivable to move air in an airflow direction through an opening in a horizontal or vertical wall of a building; and a movable fan support configured to movably support at least the fan, the fan support being mountable adjacent the opening on a first side and comprising extension members extendable from an operating position on the first side of the opening to an access position on a second side of the opening opposite the first side, wherein in the access position, the extension members extend through the opening from the first side to the second side to support the motor and fan blade on the second side of the opening for access.

17. The sidewall fan assembly of claim 16, further comprising at least one louvered door positionable on the second side and movable between a closed position covering the opening and an open position exposing the opening.

18. A wall fan assembly, comprising:

a fan having a motor and fan blade drivable to move air in an airflow direction through an opening in a wall of a building; and a movable fan support configured to movably support at least the fan, the fan support being mountable adjacent the opening on a first side and comprising extension members extendable from an operating position on the first side of the opening to an access position on a second side of the opening opposite the first side, wherein in the access position, the extension members extend through the opening from the first side to the second side to support the motor and fan blade on the second side of the opening for access.

19. The wall fan assembly of claim 18, wherein the opening in the wall is oriented approximately horizontally, and wherein the movable fan support is configured to extend approximately vertically through the opening as the fan support is moved between the operating position and the access position.

20. The wall fan of claim 19, further comprising an actuator that provides assistance with moving the fan and fan support vertically against the action of gravity.

* * * * *